US010468153B2

(12) United States Patent
Ota et al.

(10) Patent No.: US 10,468,153 B2
(45) Date of Patent: Nov. 5, 2019

(54) INSULATED ELECTRIC WIRE AND METHOD FOR PRODUCING INSULATED ELECTRIC WIRE

(71) Applicants: SUMITOMO ELECTRIC INDUSTRIES, LTD., Osaka-shi, Osaka (JP); SUMITOMO ELECTRIC WINTEC, INC., Koka-shi, Shiga (JP)

(72) Inventors: Shinya Ota, Osaka (JP); Masaaki Yamauchi, Osaka (JP); Jun Sugawara, Koka (JP); Yasushi Tamura, Koka (JP); Kengo Yoshida, Koka (JP)

(73) Assignees: SUMITOMO ELECTRIC INDUSTRIES, LTD., Osaka (JP); SUMITOMO ELECTRIC WINTEC, INC., Shiga (JP)

( * ) Notice: Subject to any disclaimer, the term of this patent is extended or adjusted under 35 U.S.C. 154(b) by 0 days.

(21) Appl. No.: 15/767,109

(22) PCT Filed: May 12, 2017

(86) PCT No.: PCT/JP2017/018042
§ 371 (c)(1),
(2) Date: Apr. 9, 2018

(87) PCT Pub. No.: WO2018/037636
PCT Pub. Date: Mar. 1, 2018

(65) Prior Publication Data

US 2019/0074106 A1 Mar. 7, 2019

(30) Foreign Application Priority Data

Aug. 25, 2016 (JP) ..... 2016-165189

(51) Int. Cl.
*H01B 7/02* (2006.01)
*H01B 13/16* (2006.01)
(Continued)

(52) U.S. Cl.
CPC ..... *H01B 7/02* (2013.01); *H01B 3/44* (2013.01); *H01B 7/0233* (2013.01); *H01B 7/17* (2013.01);
(Continued)

(58) Field of Classification Search
CPC ..... H01B 7/02; H01B 3/44
See application file for complete search history.

(56) References Cited

U.S. PATENT DOCUMENTS

2007/0082190 A1 4/2007 Endres et al.
2010/0230133 A1 9/2010 Saito et al.
2018/0033518 A1 2/2018 Ota et al.

FOREIGN PATENT DOCUMENTS

JP H08-077849 A 3/1996
JP 2004-039532 A 2/2004
(Continued)

OTHER PUBLICATIONS

Search Report in the corresponding International Patent Application No. PCT/JP2017/018042 dated Jun. 27, 2017.
(Continued)

*Primary Examiner* — Timothy J Thompson
*Assistant Examiner* — Amol H Patel
(74) *Attorney, Agent, or Firm* — Global IP Counselors, LLP

(57) ABSTRACT

An insulated electric wire includes a linear conductor and one or more of insulating layers formed on an outer peripheral surface of the conductor. In the insulated electric wire, at least one of the one or more of insulating layers has a plurality of pores, outer shells are disposed on peripheries of the pores, and each of the outer shells has a plurality of projections on an outer surface thereof.

10 Claims, 2 Drawing Sheets

(51) Int. Cl.

| | |
|---|---|
| ***H01F 5/06*** | (2006.01) |
| ***H01B 7/17*** | (2006.01) |
| ***H01B 3/44*** | (2006.01) |
| *H01B 5/00* | (2006.01) |

(52) U.S. Cl.
CPC ..... *H01B 5/004* (2013.01); *H01B 13/16* (2013.01); *H01F 5/06* (2013.01)

(56) References Cited

FOREIGN PATENT DOCUMENTS

| | | | |
|---|---|---|---|
| JP | 2012-224714 | A | 11/2012 |
| JP | 2014-051590 | A | 3/2014 |
| TW | 201419312 | A | 5/2014 |
| WO | 2017073551 | A1 | 5/2017 |

OTHER PUBLICATIONS

C Yu et al., "Synthesis of PMMA/Polysiloxane Core-Shell Latex", Matec Web of Conferences, vol. 25, Oct. 6, 2015, pp. 1-6 XP055605007.

INSULATED ELECTRIC WIRE AND METHOD FOR PRODUCING INSULATED ELECTRIC WIRE

CROSS-REFERENCE TO RELATED APPLICATIONS

This U.S. National stage application claims priority under 35 U.S.C. § 119(a) to Japanese Patent Application No. 2016-165189, filed in Japan on Aug. 25, 2016, the entire contents of which are hereby incorporated herein by reference.

TECHNICAL FIELD

The present invention relates to an insulated electric wire and a method for producing an insulated electric wire. The present invention claims priority from Japanese Patent Application No. 2016-165189 filed on Aug. 25, 2016, and the entire contents of the Japanese application are incorporated herein by reference.

BACKGROUND ART

In electrical equipment to which a high voltage is applied, for example, in a motor that is used at a high voltage, a high voltage is applied to an insulated electric wire included in the electrical equipment, and partial discharge (corona discharge) is easily generated on a surface of an insulating coating of the insulated electric wire. The generation of corona discharge may cause, for example, a local increase in the temperature, generation of ozone, and generation of ions, which may result in dielectric breakdown at an early stage and result in a decrease in the lifetime of the insulated electric wire, and by extension, the lifetime of the electrical equipment. Therefore, for insulated electric wires used in electrical equipment to which a high voltage is applied, an improvement in the corona inception voltage is also required in addition to a good insulating property, good mechanical strength, and the like.

As as solution for increasing the corona inception voltage, it is effective to realize an insulating coating having a low dielectric constant. There has been proposed an insulated electric wire that includes a heat-cured film (insulating coating) formed by using an insulating varnish containing a coating film-forming resin and a thermally decomposable resin that is decomposed at a temperature lower than a baking temperature of the coating film-forming resin in order to realize an insulating coating having a low dielectric constant (refer to Japanese Unexamined Patent Application Publication No. 2012-224714). In this insulated electric wire, pores are formed in the heat-cured film by utilizing a phenomenon in which the thermally decomposable resin is thermally decomposed during baking of the coating film-forming resin and the resulting decomposed portions become pores. This formation of the pores enables the insulating coating to have a low dielectric constant.

CITATION LIST

Patent Literature

PTL 1: Japanese Unexamined Patent Application Publication No. 2012-224714

SUMMARY OF INVENTION

Solution to Problem

An insulated electric wire according to an embodiment of the present invention is an insulated electric wire including a linear conductor and one or more of insulating layers formed on an outer peripheral surface of the conductor. In the insulated electric wire, at least one of the one or more of insulating layers has a plurality of pores, outer shells are disposed on peripheries of the pores, and each of the outer shells has a plurality of projections on an outer surface thereof.

A method for producing an insulated electric wire according to another embodiment of the present invention is a method for producing an insulated electric wire including a linear conductor and one or more of insulating layers formed on an outer peripheral surface of the conductor. The method includes an application step of applying, to the outer peripheral side of the conductor, a resin varnish containing hollow-forming particles each having a thermally decomposable core and a shell covering an outer periphery of the core; and a heating step of heating the applied resin varnish, in which the shell has a plurality of projections on an outer surface thereof.

DESCRIPTION OF EMBODIMENTS

Technical Problem

Figure 1:
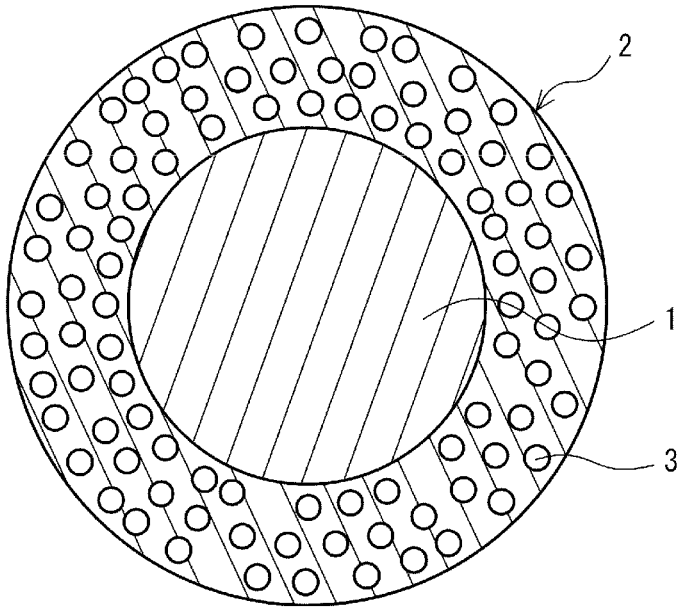
FIG. 1 is schematic sectional view illustrating an insulated electric wire according to a first embodiment of the present invention.

In the insulated electric wire, proposed in the above patent application publication, dispersibility of the thermally decomposable resin in the coating film-forming resin may become nonuniform, and as a result, pores formed in the insulating coating may be localized. When the pores formed in the insulating coating are localized, the pores derived from the thermally decomposable resin tend to communicate with each other in the insulating coating, which may result in the formation of pores having a size larger than the particle size of the thermally decomposable resin. The localization of the pores and the formation of such continuous pores may cause a decrease in, for example, the strength, insulating property, and solvent resistance of the insulating coating.

The present invention has been made on the basis of the circumstances described above. An object of the present invention is to provide an insulated electric wire and a method for producing an insulated electric wire, the insulated electric wire and the method being capable of suppressing a decrease in the strength, insulating property, and solvent resistance of an insulating layer while realizing a low dielectric constant.

Advantageous Effects of the Disclosure

An insulated electric wire and a method for producing an insulated electric wire according to the present invention can suppress a decrease in the strength, insulating property, and solvent resistance of an insulating layer while realizing a low dielectric constant.

DESCRIPTION OF EMBODIMENTS OF THE INVENTION

An insulated electric wire according to an embodiment of the present invention, which has been made to solve the problems described above, is an insulated electric wire including a linear conductor and one or more of insulating layers formed on an outer peripheral surface of the conductor. In the insulated electric wire, at least one of the one or more of insulating layers has a plurality of pores, outer shells are disposed on peripheries of the pores, and each of the outer shells has a plurality of projections on an outer surface thereof.

In the insulated electric wire, since at least one of the one or more of insulating layers has a plurality of pores, a low dielectric constant can be realized. The one or more of insulating layers of the insulated electric wire include outer shells on peripheries of the pores. Therefore, the pores are less likely to communicate with each other, and consequently, the size of the pores is unlikely to vary. Furthermore, in the insulated electric wire, since each of the outer shells has a plurality of projections on an outer surface thereof, the pores have high dispersibility in the insulating layer, and the localization of the pores is unlikely to occur in the insulating laser. Thus, the insulated electric wire can suppress a decrease in the strength, insulating property, and solvent resistance of the insulating layer.

The plurality of projections preferably have an average height of 0.01 μm or more and 0.5 μm or less. When the average height of the plurality oil projections is within the above range, dispersibility of the pores in the insulating layer can be further improved.

An average number of the projections present per unit area (14 $\mu m^2$) of one of the outer shells is preferably 5 or more and 200 or less. When the average number of the projections present per unit area (14 $\mu m^2$) of one of the outer shells is within the above range, dispersibility of the pores in the insulating layer can be further improved.

A method for producing an insulated electric wire according to an embodiment of the present invention is a method for producing an insulated electric wire including a linear conductor and one or more of insulating layers formed on an outer peripheral surface of the conductor. The method includes an application step of applying, to the outer peripheral side of the conductor, a resin varnish containing hollow-forming particles each having a thermally decomposable core and a shell covering an outer periphery of the core; and a heating step of heating the applied resin varnish, in which the shell has a plurality of projections on an outer surface thereof.

In the method for producing an insulated electric wire, a resin varnish containing hollow-forming particles each having a thermally decomposable core and a shell covering an outer periphery of the core is applied to the outer peripheral side of a conductor, and the resin varnish is heated, to thereby form, on an outer peripheral surface of the conductor, an insulating layer having a plurality of pores. Specifically, in the method for producing an insulated electric wire, when the resin varnish is heated, the cores are gasified by thermal decomposition, and portions where the cores have been present become the pores. In contrast, the shells are not thermally decomposed by the heating of the resin varnish but become outer shells on the peripheries of the pores. Accordingly, an insulating layer having a plurality of pores can be formed by the method for producing an insulated electric wire, and thus a low dielectric constant of the insulated electric wire can be realized. In the method for producing an insulated electric wire, since the shells cover the outer peripheries of the cores, the cores are less likely to be connected to each other. As a result, the size of the pores of the insulating layer is unlikely to vary. Furthermore, in the method for producing an insulated electric wire, since each of the shells has a plurality of projections on the outer surface thereof, the hollow-forming particles have high dispersibilits the resin varnish. Therefore, the method for producing an insulated electric wire can enhance the dispersibility of the pores in the insulating layer to suppress localization of the pores in the insulating layer. Accordingly, the method for producing an insulated electric wire can suppress a decrease in the strength, insulating property, and solvent resistance of the insulating layer.

Note that, in the present invention, the term "height of a projection" refers to a maximum height of a projection with respect to the outer edge of the bottom of the projection. The term "average height of protections" refers to an average of the heights of 10 projections that are arbitrarily selected. The expression "average number of projections present per unit area (14 $\mu m^2$) of one outer shell" refers to an average of the numbers of projections present in perfect circles each of which has an area of 14 $\mu m^2$ and which are arbitrarily selected in arbitrary 10 outer shells.

DETAILS OF EMBODIMENTS OF THE INVENTION

An insulated electric wire according to an embodiment of the present invention will now be described in detail with reference to the drawings.

First Embodiment Insulated

<Insulated Electric Wire>

Figure 2:
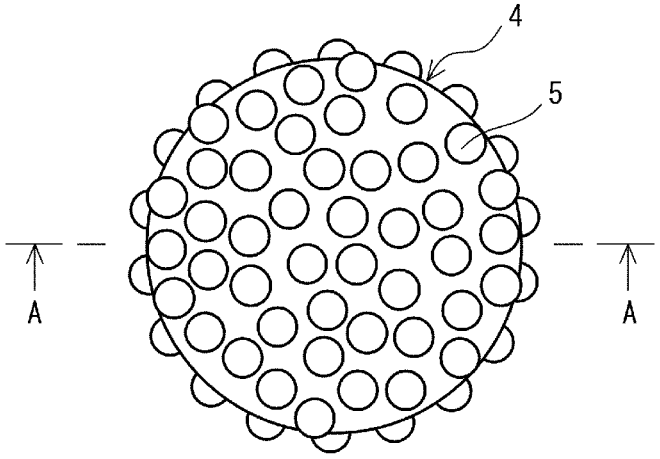
FIG. 2 is schematic view illustrating an outer shell of the insulated electric wire in FIG. 1.
Figure 3:
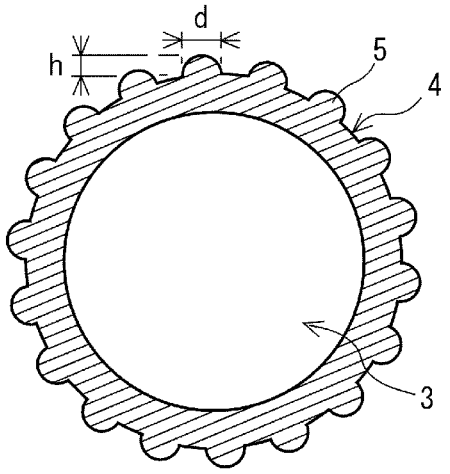
FIG. 3 is an end face view taken along line A-A in FIG. 2.

An insulated electric wire in FIG. 1 includes a linear conductor 1 and a single insulating layer 2 formed on the outer peripheral surface of the conductor 1. The insulating layer 2 has a plurality of pores 3. As illustrated in FIGS. 2 and 3, the insulated electric wire includes an outer shell 4 on the periphery of each of the pores 3, and the outer shell 4 has a plurality of projections 5 on the outer surface thereof.

Since the insulated electric wire, includes the insulating layer 2 having the plurality of pores 3, a low dielectric constant can be realized. Since the insulating layer 2 of the insulated electric wire includes the outer shells 4 on the peripheries of the pores 3, the pores 3 are less likely to communicate with each other. As a result, the size of the pores 3 of the insulating layer 2 is unlikely to vary. Furthermore, in the insulated electric wire, since each of the outer shells 4 has the plurality of projections 5 on the outer surface thereof, the pores 3 have high dispersibility in the insulating layer 2, and the localization of the pores 3 is unlikely to occur in the insulating layer 2. Accordingly, the insulated electric wire can suppress a decrease in the strength, insulating property, and solvent resistance of the insulating layer 2.

Since the insulated electric wire has high dispersibility of the pores 3 in the insulating layer 2, the quality can be easily made uniform, and the yield of the resulting product can be improved accordingly.

The localization of pores tends to cause breakage of an insulating layer due to overlapping of the pores when an insulated electric wire is stretched in the axial direction or bent in the radial direction. In contrast, the above-described insulated electric wire has high dispersibility of the pores 3 in the insulating layer 2. Accordingly, even when the insulated electric wire is stretched in the axial direction or bent in the radial direction, breakage of the insulating layer 2 can be suppressed, to thereby enhance durability. Therefore, the insulated electric wire is suitable for, for example, a winding wire.

(Conductor)

The conductor 1 is, for example a round wire having a circular section. Alternatively, the conductor 1 may be a rectangular wire having a rectangular section or a stranded wire obtained by twisting a plurality of element wires together.

The material of the conductor 1 is preferably a metal having high conductivity and high mechanical strength. Examples of such a metal include copper, copper alloys, aluminum, nickel, silver, soft iron, steel, and stainless steel. Examples of the conductor 1 that can be used include materials obtained by forming any of these metals to have a linear shape, material having a multilayer structure obtained by coating such a linear material with another metal, such as a nickel-coated copper wire, a silver-coated copper wire, a copper-coated aluminum wire, and a copper-coated steel wire.

The lower limit of the average sectional area of the conductor 1 is preferably 0.01 $mm^2$ and more preferably 0.1 $mm^2$. The upper limit of the average sectional area of the conductor 1 is preferably 20 $mm^2$ and more preferably 10 $mm^2$. When the average sectional area of the conductor 1 is less than the lower limit, the volume of the insulating layer 2 relative to that of the conductor 1 becomes large, which may result in a decrease in the volumetric efficiency of a coil or the like formed by using the insulated electric wire. On the other hand, when the average sectional area of the conductor 1 exceeds the upper limit, it is necessary to form the insulating layer 2 having a large thickness in order to sufficiently decrease the dielectric constant, and the insulated electric wire may have an unnecessarily large diameter.

(Insulating Layer)

The insulating layer 2 includes a resin matrix, a plurality of pores 3 disposed in the resin matrix in a dispersed manner, and outer shells 4 formed on peripheries of the pores 3. As described below, the insulating layer 2 is formed by applying, to an outer peripheral surface of the conductor 1, a resin varnish that contains hollow-forming particles each having a core-shell structure including a thermally decomposable core and a shell covering the outer periphery of the core, and heating the resin varnish.

The pores 3 are formed by gasification of the cores of the hollow-forming particles. The outer shells 4 are constituted by the shells that become hollow as a result of the removal of the cores of the hollow-forming particles. That is, the pores 3 are derived from the core of the hollow-forming particles having the core-shell structure, and the outer shells 4 are derived from the shells of the hollow-forming particles.

The lower limit of the average size of the pores 3 is preferably 0.5 μm and more preferably 2 μm. The upper limit of the average size of the pores 3 is preferably 10 μm and more preferably 5 μm. When the average size of the pores 3 is less than the lower limit, it may become difficult to sufficiently increase the porosity of the insulating layer 2. On the other hand, when the average size of the pores 3 exceeds the upper limit, it may become difficult to sufficiently promote uniform distribution of the pores 3 in the insulating layer 2.

The outer shells 4 each preferably have, in a part thereof, a defect that penetrates from the inside to the outside. In the insulated electric wire, a gasified core is released through this defect to the outside, and the pore 3 can be thereby formed in the outer shell 4. The shapes of the defects vary depending on the material and the shape of the shells. The defects are preferably cracks, gaps, and holes from the viewpoint of enhancing the effect of preventing the pores 3 from communicating with each other, the effect being exerted by the outer shells 4. The insulating layer 2 may include outer shells 4 free of defects. Under some conditions for releasing the gasified cores to the outside of the shells, defects may not be formed in the shells. From the viewpoint of improving dispersibility of the pores 3, the insulating layer 2 preferably includes the outer shells 4 on the peripheries of all the pores 3. However, the insulating layer 2 may include some pores 3 that are not covered with the outer shells 4.

The lower limit of a ratio of the number of pores 3 including the outer shells 4 to the total number of pores 3 present in the insulating layer 2 is preferably 70%, more preferably 90%, and most preferably 100%. When the ratio of the number is less than the lower limit, the dispersibility of the pores 3 in the insulating layer 2 may not sufficiently improve, or continuous pores in which a plurality of pores 3 communicate with each other may be formed.

As illustrated in FIGS. 2 and 3, each of the outer shells 4 has a plurality of projections 5 disposed on the outer surface thereof at substantially regular intervals. Accordingly, the outer shell 4 has an outer shape similar to a raspberry or a star-shaped rock candy.

The lower limit of the average number of projections 5 present per unit area (14 $\mu m^2$) of one outer shell is preferably 5 and more preferably 10. The upper limit of the number is preferably 200 and more preferably 100. When the number is less than the lower limit, the dispersibility of the pores 3 in the insulating layer 2 may become insufficient. On the other hand, when the number exceeds the upper limit, the effect of improving the dispersibility of the pores 3, the effect being exerted by the plurality of projections 5, may not be significantly enhanced. When the number exceeds the upper limit, it may become difficult to form the defects in the outer shells 4, which may result in a difficulty in the formation of the pores 3.

The lower limit of the average height h of the plurality of projections 5 is preferably 0.01 μm and more preferably 0.05 μm. The upper limit of the average height h of the plurality of projections 5 is preferably 0.5 μm and more preferably 0.4 μm. When the average height h is less than the lower limit, the dispersibility of the pores 3 in the insulating layer 2 may become insufficient. On the other hand, when the average height h exceeds the upper limit, the gap between the pores 3 in the insulating layer 2 is unnecessarily increased, and it may become difficult to sufficiently increase the porosity of the insulating layer 2.

The lower limit of the average diameter d at the bottom of the plurality of projections 5 is preferably 0.05 μm and more preferably 0.1 μm. The upper limit of the average diameter d at the bottom of the plurality of projections 5 is preferably 1.0 μm and more preferably 0.5 μm. When the average diameter d is less than the lower limit, it becomes difficult to cause the projections 5 of adjacent outer shells 4 to interfere with each other. As a result, the dispersibility of the pores 3 in the insulating layer 2 may become insufficient. On the other hand, when the average diameter d exceeds the upper limit, regions other than the projections 5 are decreased in the outer shells 4. As a result, it may become difficult to form the defects. The term "diameter at the bottom of a projection" refers to a diameter when an inner region of the outer edge of the bottom of a projection is converted to a perfect circle having the same area. The term "average diameter at the bottom of projections" refers to an average of the diameters at the bottom of 10 projections that are arbitrarily selected.

The lower limit of the average thickness of the outer shells 4 is not particularly limited but is preferably 0.01 μm and more preferably 0.02 μm. The upper limit of the average thickness of the outer shells 4 is preferably 0.5 μm and more preferably 0.4 μm. When the average thickness of the outer shells 4 is less than the lower limit, the effect of suppressing communication between the pores 3 may not be sufficiently achieved. On the other hand, when the average thickness of the outer shells 4 exceeds the upper limit, the pores 3 have an excessively small volume, and thus the porosity of the insulating layer 2 may not be increased to a particular value or more. The term "average thickness of outer shells" refers to an average thickness of portions other than a plurality of projections. Each of the outer shells 4 may be formed of a single layer or a plurality of layers. When the outer shell 4 is formed of a plurality of layers, the term "average thickness" means an average thickness of the total of the plurality of layers.

From the viewpoint of improving the dispersibility of the pores 3, a plurality of projections 5 are preferably formed on the outer surfaces of all the outer shells 4 in the insulating layer 2. However, the insulating layer 2 may include some outer shells 4 that do not have the projections 5. The lower limit of a ratio of the number of outer shells 4 having projections to the total number of outer shells 4 present in the insulating layer 2 is preferably 70%, more preferably 90%, and most preferably 100%. When the ratio of the number is less than the lower limit, the dispersibility of the pores 3 in the insulating layer 2 may not sufficiently improve.

The outer shell 4 is formed of a material having a higher thermal decomposition temperature than the core. The outer shell 4 may be formed of the same material as the resin matrix or a material different from the resin matrix. A main component of the outer shell 4 is preferably a synthetic resin having a low dielectric constant and high heat resistance. Examples thereof include polystyrene, silicones, fluororesins, and polyimides. Of these, silicones are preferred because they can easily enhance elasticity, to thereby easily improve the dispersibility of the shells in the resin varnish, and have a good insulating property and good heat resistance. The term "fluororesin" refers to a resin in which at least one hydrogen atom bonded to a carbon atom forming a repeating unit of the polymer chain is substituted with a fluorine atom or an organic group having a fluorine atom (hereinafter, may be referred to as a "fluorine atom-containing group"). The fluorine atom-containing group is a group in which at least one hydrogen atom in as linear or branched organic group is substituted with a fluorine atom. Examples of the fluorine atom-containing group include fluoroalkyl groups, fluoroalkoxy groups, and fluoropolyether groups. The outer shell 4 may contain a metal within a range in which an insulating property is not impaired. The term "main component" racers to a component having the highest content, and refers to a component contained in an amount of, for example, 50% by mass or more.

Examples of the main component of the resin matrix include polyvinylformal, polyurethanes, acrylic resins, epoxy resins, phenoxy resins, polyesters, polyester imides, polyester amide-imides, polyamide-imides, polyimides, polyetherimides, polyether, ether ketones, and polyether sulfones. Of these, polyimides, which easily improve strength and heat resistance of the insulating layer 2, are preferred. The resin matrix may be formed of a composite or a laminate of two or more synthetic resins.

In addition to the above components, other components such as a filler, an antioxidant, a leveling agent, a curing agent, and an adhesive aid may be added to the insulating layer 2.

The lower limit of the average thickness of the insulating layer 2 is preferably 5 μm and more preferably 10 μm. The upper limit of the average thickness of the insulating layer 2 is preferably 200 μm and more preferably 300 μm. When the average thickness of the insulating layer 2 is less than the lower limit, the insulating layer 2 may be torn, and insulation of the conductor 1 may become insufficient. On the other hand, when the average thickness of the insulating layer 2 exceeds the upper limit, the volumetric efficiency of a coil or the like formed by using the insulated electric wire may decrease.

The lower limit of the porosity of the insulating layer 2 is preferably 5% by volume and more preferably 10% by volume.

The upper limit of the porosity of the insulating layer 2 is preferably 80% by volume and more preferably 50% by volume. When the porosity of the insulating layer 2 is less than the lower limit, the dielectric constant of the insulating layer 2 does not sufficiently decrease, and the corona inception voltage may not be sufficiently improved. On the other hand, when the porosity of the insulating layer 2 exceeds the upper limit, the insulating layer 2 may not maintain mechanical strength. The term "porosity" refers to the percentage of the volume of pores relative to the volume of an insulating layer including the pores.

The upper limit of a ratio of the dielectric constant of the insulating layer 2 relative to the dielectric constant of a layer that is formed of the same material as the insulating layer 2 and that is free of pores is preferably 95%, more preferably 90%, and still more preferably 80%. When the ratio of the dielectric constant exceeds the upper limit, the corona inception voltage may not be sufficiently improved.

<Method for Producing Insulated Electric Wire>

Next, a method for producing the insulated electric wire illustrated in FIG. 1, the insulated electric wire including a linear conductor 1 and an insulating layer 2 formed on the outer peripheral surface of the conductor 1, will be described with reference to FIG. 4. The method for producing an insulated electric wire includes an application step of applying, to the outer peripheral side of the conductor 1, a resin varnish containing hollow-forming particles 6 each having a thermally decomposable core 3*a* and a shell 4*a* covering an outer periphery of the core 3*a*; and a heating step of heating the resin varnish applied in the application step, in which the shell 4*a* has a plurality of projections 5*a* on an outer surface thereof.

In the method for producing an insulated electric wire, a resin varnish containing hollow-forming particles 6 each having a thermally decomposable core 3*a* and a shell 4*a* covering the outer periphery of the core 3*a* is applied to the outer peripheral side of a conductor 1, and the resin varnish is heated, to thereby form, on an outer peripheral surface of the conductor 1, an insulating layer 2 having a plurality of pores 3. Specifically, in the method for producing an insulated electric wire, when the resin varnish is heated, the cores 3*a* are gasified by thermal decomposition, and portions where the cores 3*a* have been present become the pores 3. In contrast, the shells 4*a* are not thermally decomposed by the heating of the resin varnish but become outer shells 4 on the peripheries of the pores 3. Accordingly, an insulating layer 2 having a plurality of pores 3 can be formed by the method for producing an insulated electric wire, and thus a low dielectric constant of the insulated electric wire can be realized. In the method for producing an insulated electric wire, since the shells 4*a* cover the outer peripheries of the cores 3*a*, the cores 3*a* are less likely to be connected to each other. As a result, the size of the pores 3 of the insulating layer 2 is unlikely to vary. Furthermore, in the method for producing an insulated electric wire, since the shells 4*a* each have a plurality of projections 5*a* on the outer surface thereof, the hollow-forming particles 6 have high dispersibility in the resin varnish. Therefore, the method for producing an insulated electric wire can enhance the dispersibility of the pores 3 in the insulating layer 2 to suppress localization of the pores 3 in the insulating layer 2. Accordingly, the method for producing an insulated electric wire can suppress a decrease in the strength, insulating property, and solvent resistance of the insulating layer 2.

(Resin Varnish)

First, the resin varnish used in the method for producing an insulated electric wire will be described. The resin varnish used is a varnish prepared by diluting a main polymer that forms the resin matrix of the insulating layer 2 and hollow-forming particles 6 to be dispersed in this main polymer with a solvent. The resin varnish may contain other components such as a filler, an antioxidant, a leveling agent, a curing agent, and an adhesive aid.

<Main Polymer>

Examples of the main polymer include, but are not particularly limited to, precursors such as polyvinylformal precursors, polyurethane precursors, acrylic resin precursors, epoxy resin precursors, phenoxy resin precursors, polyester precursors, polyester imide precursors, polyester amide-imide precursors, polyamide-imide precursors, and polyimide precursors; polyetherimides; polyether ether ketones; and polyether sulfones. Of these, polyimide precursors, which can improve a coating property of the resin varnish and easily improve strength and heat resistance of the insulating layer 2, are preferred.

Hollow-Forming Particle>

Figure 4:
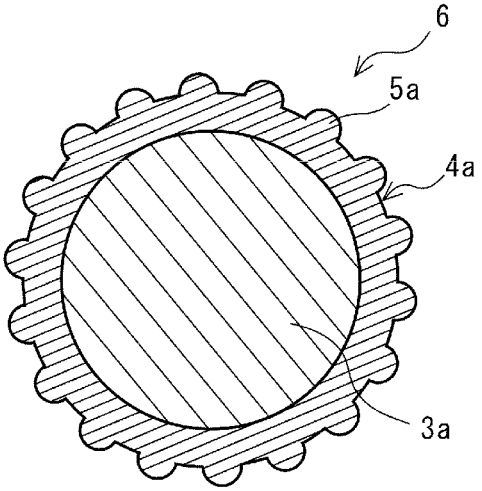
FIG. 4 is a schematic end face view illustrating a hollow-forming particle used in a method for producing the insulated electric wire in FIG. 1.

As illustrated in FIG. 4, the hollow-forming particle 6 includes a core 3*a* containing a thermally decomposable resin as a main component and a shell 4*a* having a higher thermal decomposition temperature than the thermally decomposable resin.

The thermally decomposable resin used as the main component of the core 3*a* is a resin particle that is thermally decomposed at a temperature lower than a baking temperature of the main polymer contained in the resin varnish and forming the resin matrix of the insulating layer 2. The baking temperature of the main polymer is appropriately determined in accordance with the type of the resin and is usually about 200° C. or higher and 600° C. or lower. Accordingly, the lower limit of the thermal decomposition temperature of the thermally decomposable resin used for the core 3*a* of the hollow-forming particle 6 is preferably 200° C., and the upper limit of the thermal decomposition temperature is preferably 400° C. Herein, the term "thermal decomposition temperature" refers to a temperature at which the mass is reduced by 50% when the temperature is increased from room temperature at a rate of 10° C./min in an air atmosphere. The thermal decomposition temperature can be determined by, for example, thermogravimetry using a thermogravimetry-differential thermal analyzer ("TG/DTA" available from SII NanoTechnology Inc.).

Examples of the thermally decomposable resin used for the core 3*a* of the hollow-forming particle 6 include, but are not particularly limited to, compounds obtained by alkylation, (meth)acrylation, or epoxidation of one terminal, two terminals, or a part of polyethylene glycol, polypropylene glycol, or the like; polymers of (meth)acrylic acid esters having an alkyl group with 1 to 6 carbon atoms, such as polymethyl (meth)acrylate, polyethyl (meth)acrylate, polypropyl (meth)acrylate, and polybutyl (meth)acrylate; urethane oligomers; urethane polymers; and polymers of modified (meth)acrylates such as urethane (meth)acrylates, epoxy (meth)acrylates, and ε-caprolactone (meth)acrylates; poly (meth)acrylic acids; cross-linked products thereof, polystyrene; and cross-linked polystyrene. Of these, polymers of (meth)acrylic acid esters having an alkyl group with 1 to 6 carbon atoms are preferred from the viewpoint that these polymers easily thermally decompose at the baking temperature of the main polymer to easily form the pores 3 in the insulating layer 2. An example of such a polymer of a (meth)acrylic acid ester is polymethyl methacrylate (PMMA).

The shape of the core 3*a* is preferably a spherical shape. For example, a spherical, thermally decomposable resin particle is preferably used as the core 3*a* so that the core 3*a* has a spherical shape. When spherical, thermally decomposable resin particles are used, the mean particle size of the thermally decomposable resin particles may be the same of the above-described average size of the pores 3. Herein, the term "mean particle size" of the thermally decomposable resin particles refers to a panicle size exhibiting the highest volume content in a particle size distribution measured with a laser diffraction particle size distribution analyzer.

As the main component of the shell 4*a*, a material having a higher thermal decomposition temperature than the thermally decomposable resin is used. The main component of the shell 4*a* is preferably a material having a low dielectric constant and high heat resistance.

As the main component of the shell 4*a*, a synthetic resin that is the same as the main component of the outer shell 4 can be used.

The main component of the shell 4*a* may be the same as or different from the main polymer contained in the resin varnish. For example, even when a resin that is the same as the main polymer is used as the main component of the shell 4*a*, the effect of suppressing communication between the pores 3 is provided. This is because, since the resin serving as the main component of the shell 4*a* has a higher thermal decomposition temperature than the thermally decomposable resin, the resin serving as the main component of the shell 4*a* is unlikely to decompose even when the thermally decomposable resin is gasified. With regard to the insulated electric wire formed by using such a resin varnish, the presence of the shell 4*a* may not be confirmed even when the insulated electric wire is observed with an electron microscope. In contrast, when a resin different from the main polymer is used as the main component of the shell 4*a*, the likelihood of the shell 4*a* being integrated with the main polymer can be reduced. Consequently, the effect of suppressing communication between the pores 3 is easily provided.

The average thickness of the shells 4*a* may be the same as the above-described average thickness of the outer shells 4.

Each of the shells 4*a* has a plurality of projections 5*a* on the outer surface thereof at substantially regular intervals. The average number of the projections 5*a* present per unit area (14 $\mu m^2$) of one shell may be the same as the above-described average number of the projections 5 present per unit area (14 $\mu m^2$) of one outer shell. The average height of the plurality of projections 5*a* may be the same as the above-described average height h of the projections 5 in the outer shells 4. The average diameter at the bottom of the plurality of projections 5*a* may be the same as the above-described average diameter d at the bottom of the plurality of projections 5 in the outer shells 4.

The lower limit of the content of the shells 4*a* in the hollow-forming particles 6 is preferably 5% by mass and more preferably 10% by mass. The upper limit of the content of the shells 4*a* in the hollow-forming particles 6 is preferably 35% by mass and more preferably 25% by mass. When the content is less than the lower limit, the number and the height of the projections 5*a* are insufficient, and dispersibility of the pores 3 in the insulating layer 2 may become insufficient. On the other hand, when the content exceeds the upper limit, the projections 5*a* each have an excessively large size, the gap between the pores 3 in the insulating layer 2 is unnecessarily increased, and it may become difficult to sufficiently increase the porosity of the insulating layer 2.

The upper limit of a CV value of portions of the hollow-forming particles 6, the portions being other than the projections 5*a*, is preferably 30% and more preferably 20%. When the CV value exceeds the upper limit, the insulating layer 2 includes a plurality of pores 3 having different sizes, which may easily cause unevenness of the distribution of the dielectric constant.

The lower limit of the CV value is not particularly limited, but is, for example, preferably 1%. When the CV value is less than the lower limit, the cost of the hollow-forming particles 6 may become excessively high. The term "CV value" refers to a coefficient of variation specified in JIS-Z8825:2013.

The hollow-forming particles 6 may each have a structure in which the core 3*a* is formed of a single thermally decomposable resin particle. Alternatively, the thermally decomposable resin particles 6 may each have a structure in which the core 3*a* is formed of a plurality of thermally decomposable resin particles, and these plurality of thermally decomposable resin particles are covered with the synthetic resin of the shell 4*a*.

<Solvent>

The solvent may be selected from known organic solvents that have been used for resin varnishes for insulated electric wires. Specific examples thereof include polar organic solvents such as N-methyl-2-pyrrolidone, N,N-dimethylacetamide, N,N-dimethylformamide, dimethyl sulfoxide, tetramethylurea, hexaethylphosphoric triamide, and γ-butyrolactone; ketones such as acetone, methyl ethyl ketone, methyl isobutyl ketone, and cyclohexanone; esters such as methyl acetate, ethyl acetate, butyl acetate, and diethyl oxalate; ethers such as diethyl ether, ethylene glycol dimethyl ether, diethylene glycol monomethyl ether, ethylene glycol monobutyl ether (butyl cellosolve), diethylene glycol dimethyl ether, and tetrahydrofuran; hydrocarbons such as hexane, heptane, benzene, toluene, and xylene; halogenated hydrocarbons such as dichloromethane and chlorobenzene; phenols such as cresol and chlorophenol; and tertiary amines such as pyridine. These organic solvents may be used alone or as a mixture of two or more thereof.

The lower limit of the resin solid content of the resin varnish is preferably 15% by mass and more preferably 20% by mass. The upper limit of the resin solid content of the resin varnish is preferably 50% by mass and more preferably 30% by mass. When the resin solid content of the resin varnish is less than the lower limit, a layer that can be formed by applying the varnish once has a small thickness. Accordingly, the number of times of repetition of the varnish application step for forming an insulating layer 2 having a desired thickness increases, which may result in an increase in the time of the varnish application step. On the other hand, when the resin solid content of the resin varnish exceeds the upper limit, the resulting varnish thickens, which may decrease storage stability of the varnish.

In order to form pores, in addition to the hollow-forming particles 6, a pore-forming agent such as thermally decomposable particles may be incorporated in the resin varnish. Alternatively, in order to form pores, the resin varnish may be prepared by using diluting solvents having different boiling points in combination. The pores formed by the pore-forming agent and the pores formed by the combination of diluting solvents having different boiling points are unlikely to communicate with the pores derived from the hollow-forming particles 6. Accordingly, even when the insulating layer 2 includes pores that are not covered with the outer shells 4 in this manner, the generation of coarse pores in the insulating layer 2 is suppressed by the presence of the pores covered with the outer shells 4.

(Application Step)

In the application step, the resin varnish described above is applied to the outer peripheral side of a conductor 1. An example of the method for applying the resin varnish is a method using a coating device including a storage tank that stores the resin varnish and a coating die. According to this coating device, when the conductor 1 is inserted into the storage tank, the resin varnish adheres to the outer peripheral side of the conductor 1. Subsequently, the resulting conductor 1 passes through the coating die. As a result, the resin varnish is applied so as to have a substantially uniform thickness.

(Heating Step)

In the heating step, the resin varnish applied in the application step is heated. In the heating step, the resin varnish is baked on the outer peripheral side of the conductor 1 to form an insulating layer 2 on the outer peripheral side of the conductor 1. Examples of the heating method in the heating step include, but are not particularly limited to, known methods such as hot air heating, infrared heating and high-frequency heating. The heating temperature in the heating step is usually 200° C. or higher and 600° C. or lower.

In the method for producing an insulated electric wire, the application step and the heating step are preferably repeated a plurality of times. That is, the insulating layer 2 is preferably formed as a laminate of a plurality of baked layers. Such an insulating layer 2 formed as a laminate of a plurality of baked layers easily has enhanced dispersibility of the pores 3 because the pores 3 are formed in each of the baked layers.

Other Embodiments

It is to be understood that the embodiments disclosed herein are only illustrative and are not restrictive in all respects. The scope of the present invention is not limited to the configurations of the embodiments and is defined by the claims described below. The scope of the present invention is intended to cover all the modifications within the meaning and range of equivalents of the claims.

In the embodiments, a description has been made of an insulated electric wire in which a single insulating layer is formed on the outer peripheral surface of a conductor. Alternatively, the insulated electric wire may have a structure in which a plurality of insulating layers are formed on the outer peripheral surface of a conductor. Specifically, one or more of insulating layers may be formed between the conductor 1 and the insulating layer 2 having the plurality of pores 3 in FIG. 1. Alternatively, one or more of insulating layers may be formed on the outer peripheral surface of the insulating layer 2 having the plurality of pores 3 in FIG. 1. Alternatively, one or more of insulating layers may be formed on each of the outer peripheral surface and the inner peripheral surface of the insulating layer 2 having the plurality of pores 3 in FIG. 1. In such an insulated electric wire including a plurality of insulating layers, at least one insulating layer has a plurality of pores and outer shells formed on the peripheries of the pores and each having a plurality of projections on the outer surface thereof. That is, two or more insulating layers may have a plurality of pores and outer shells formed on the peripheries of the pores and each having a plurality of projections on the outer surface thereof.

In the insulated electric wire, for example, an additional layer such as a primer treatment layer may be further disposed between the conductor and the insulating layer. The primer treatment layer is provided in order to enhance adhesiveness between layers and can be formed by using, for example, a known resin composition.

In the case where a primer treatment layer is disposed between the conductor and the insulating layer, the resin composition for forming the primer treatment layer preferably contains one or more of resins selected from, for example, polyimides, polyamide-imides, polyester-imides, polyesters, and phenoxy resins. The resin composition for forming the primer treatment layer may contain an additive such as an adhesion improver. Formation of a primer treatment layer formed of such a resin composition between the conductor and the insulating layer enables improvement in adhesiveness between the conductor and the insulating layer. As a result, properties of the insulated electric wire, such as flexibility, abrasion resistance, scratch resistance, and process resistance can be effectively enhanced.

The resin composition for forming the primer treatment layer may contain, in addition to the resins mentioned above, other resins such as epoxy resins and melamine resins. Commercially available liquid compositions (insulating varnishes) may be used as the resins contained in the resin composition for forming the primer treatment layer.

The lower limit of the average thickness of the primer treatment layer is preferably 1 μm and more preferably 2 μm. The upper limit of the average thickness of the primer treatment layer is preferably 30 μm and more preferably 20 μm. When the average thickness of the primer treatment layer is less than the lower limit, sufficient adhesiveness to the conductor may not be exhibited. On the other hand, when the average thickness of the primer treatment layer exceeds the upper limit, the insulated electric wire may have an excessively large diameter.

EXAMPLES

The present invention will now be described in more detail by way of Examples. However, the present invention is not limited to these Examples.

EXAMPLES

[No. 1]

First, copper was cast, stretched, subjected to wire drawing, and softened to obtain a conductor having a circular section and an average diameter of 1 mm. A resin composition was prepared by diluting a main polymer with a solvent by using a polyimide precursor as the main polymer and N-methyl-2-pyrrolidone as the solvent. Core/shell composite particles including cores formed of PMMA particles and having a mean particle size of 3.0 μm and shells formed of a silicone were used as hollow-forming particles. The hollow-forming particles were then dispersed in the resin composition to prepare a resin varnish. The shells of the core/shell composite particles had a plurality of projections on the outer surfaces thereof. The average height of the projections was 0.1 μm, the average diameter at the bottom of the projections was 0.1 μm, and the average number of the projections present per unit area (14 $\mu m^2$) of one shell was 90. The core/shell composite particles had a silicone content of 10% by mass. The resin varnish was applied to the outer peripheral surface of the conductor and baked at a linear velocity of 25 m/min, at a heating furnace inlet temperature of 350° C., and at a heating furnace, outlet temperature of 450° C. to form an insulating layer. Thus, an insulated electric wire No. 1 was obtained. The insulating layer was a single layer and had an average thickness of 30 μm. This insulated electric wire had pores formed by gasification of the cores, and outer shells constituted by the shells that became hollow as a result of removal of the core and having a plurality of projections on the outer surfaces thereof. Furthermore, the average height of the projections on the outer shells, the average diameter at the bottom of these projections, and the number of these projections present per unit area (14 $\mu m^2$) of one outer shell were respectively the same as the average height of the projections formed on the outer surfaces of the shells, the average diameter at the bottom of the projections, and the number of the projections present per unit area (14 $\mu m^2$) of one shell. The insulating layer of this insulated electric wire had a porosity of 30% by volume.

[No. 2]

An insulated electric wire No. 2 was prepared as in No. 1 except that core/shell composite particles that included shells having an average height of projections of 0.2 μm, an average diameter at the bottom of the projections of 0.2 μm, and an average number of the projections present per unit area (14 $\mu m^2$) of one shell of 38, and that had a silicone content of 17% by mass were used as the hollow-forming particles. In this insulated electric wire, the average height of the projections on the outer shells, the average diameter at the bottom of these projections, and the number of these projections present per unit area (14 $\mu m^2$) of one outer shell were respectively the same as the average height of the projections formed on the outer surfaces of the shells, the average diameter at the bottom of the projections, and the number of the projections present per unit area (14 $\mu m^2$) of one shell. The insulating layer of this insulated electric wire had a porosity of 30% by volume.

[No. 3]

An insulated electric wire No. 3 was prepared as in No. 1 except that core/shell composite particles that included shells having an average height of projections of 0.3 μm, an average diameter at the bottom of the projections of 0.4 μm, and an average number of the projections present per unit area (14 $\mu m^2$) of one shell of 15, and that had a silicone content of 25% by mass were used as the hollow-forming particles. In this insulated electric wire, the average height of the projections on the outer shells, the average diameter at the bottom of these projections, and the number of these projections, present per unit area (14 $\mu m^2$) of one outer shell were respectively the same as the average height of the projections formed on the outer surfaces of the shell, the average diameter at the bottom of the projections, and the number of the projections present per unit area (14 $\mu m^2$) of one shell. The insulating layer of this insulated electric wire had a porosity of 30% by volume.

COMPARATIVE EXAMPLE

[No. 4]

An insulated electric wire No. 4 was prepared as in No. 1 except that core/shell composite particles that included shells having no projections on the outer surfaces thereof were used as the hollow-forming particles. The core/shell composite particles included cores having an average size of 2.5 μm, and a silicone content of 10% by mass. The insulated electric wire No. 4 had pores formed by gasification of the cores, and outer shells constituted by the shells that became hollow as a result of removal of the core. The outer shells had no projections on the outer surfaces thereof.

<Quality>

Regarding the insulated electric wire Nos. 1 to 3, since the outer shells each had a plurality of projections on the outside thereof, the insulated electric wires had good dispersibility of pores, and continuous pores in which pores communicated with each other were not observed. In the insulated electric wire Nos. 1 to 3, with an increase in the silicone content in the hollow-forming particles, the size of the projections increased, and the gap between the pores also increased accordingly.

In contrast, regarding the insulated electric wire No. 4, since the outer shells did not have projections on the outer surfaces thereof, portions where the pores aggregated with each other were observed, showing that the dispersibility of the pores was insufficient.

REFERENCE SIGNS LIST

1 conductor
2 insulating layer
3 pore
3*a* core
4 outer shell
4*a* shell
5, 5*a* projection
6 hollow-forming particle

The invention claimed is:

1. An insulated electric wire comprising a linear conductor and one or more of insulating layers formed on an outer peripheral surface of the conductor, wherein at least one of the one or more of insulating layers has a plurality of pores, outer shells are disposed on peripheries of the pores, and each of the outer shells has a plurality of projections on an outer surface thereof.

2. The insulated electric wire according to claim 1, wherein the plurality of projections have an average height of 0.01 μm or more and 0.5 μm or less.

3. The insulated electric wire according to claim 1, wherein an average number of the projections present per unit area of one of the outer shells is 5 or more and 200 or less.

4. The insulated electric wire according to claim 1, wherein the outer shell includes silicone as a main component.

5. The insulated electric wire according to claim 1, wherein the one or more of the insulating layers include polyimides as a main component.

6. The insulated electric wire according to claim 1, wherein the outer shells have an average thickness of 0.01 μm or more and 0.5 μm or less.

7. The insulated electric wire according to claim 1, wherein the pores have an average size of 0.5 μm or more and 10 μm or less.

8. The insulated electric wire according to claim 1, wherein the insulated electric wire further comprises a primer treatment layer, and the primer treatment layer is disposed between the conductor and the insulating layer.

9. The insulated electric wire according to claim 1, wherein a ratio of a dielectric constant of the insulating layer relative to a dielectric constant of a layer that is formed of the same material as the insulating layer and that is free of pores is 95% or less.

10. A method for producing an insulated electric wire including a linear conductor and one or more of insulating layers formed on an outer peripheral surface of the conductor, the method comprising:

an application step of applying, to the outer peripheral side of the conductor, a resin varnish containing hollow-forming particles each having a thermally decomposable core and a shell covering an outer periphery of the core; and a heating step of heating the applied resin varnish, wherein the shell has a plurality of projections on an outer surface thereof.

* * * * *